US007597608B2

(12) United States Patent
Chang et al.

(10) Patent No.: US 7,597,608 B2
(45) Date of Patent: Oct. 6, 2009

(54) PAD CONDITIONING DEVICE WITH FLEXIBLE MEDIA MOUNT

(75) Inventors: Shou-Sung Chang, Stanford, CA (US); Steven M. Zuniga, Soquel, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 11/928,677

(22) Filed: Oct. 30, 2007

(65) Prior Publication Data

US 2008/0102737 A1 May 1, 2008

Related U.S. Application Data

(60) Provisional application No. 60/863,563, filed on Oct. 30, 2006.

(51) Int. Cl.
*B24B 1/00* (2006.01)

(52) U.S. Cl. ..... 451/56; 451/443

(58) Field of Classification Search ..... 451/56, 451/443

See application file for complete search history.

(56) References Cited

U.S. PATENT DOCUMENTS

| | | | | |
|---|---|---|---|---|
| 5,216,843 | A | 6/1993 | Breivogel et al. | |
| 5,456,627 | A | 10/1995 | Jackson et al. | |
| 5,486,131 | A | 1/1996 | Cesna et al. | |
| 5,531,635 | A | 7/1996 | Mogi et al. | |
| 5,547,417 | A | 8/1996 | Breivogel et al. | |
| 5,605,499 | A | 2/1997 | Sugiyama et al. | |
| 5,655,951 | A | 8/1997 | Meikle et al. | |
| 5,885,137 | A | 3/1999 | Ploessl | |
| 5,885,147 | A | 3/1999 | Kreager et al. | |
| 5,902,173 | A | 5/1999 | Tanaka | |
| 5,957,754 | A | 9/1999 | Brown et al. | |
| 5,964,653 | A | 10/1999 | Perlov et al. | |
| 6,019,670 | A | 2/2000 | Cheng et al. | |
| 6,024,630 | A | 2/2000 | Shendon et al. | |
| 6,027,659 | A | 2/2000 | Billett | |
| 6,036,583 | A | 3/2000 | Perlov et al. | |
| 6,099,393 | A * | 8/2000 | Katagiri et al. | 451/56 |
| 6,106,371 | A * | 8/2000 | Nagahara et al. | 451/56 |
| 6,190,243 | B1 * | 2/2001 | Wada et al. | 451/288 |
| 6,213,852 | B1 | 4/2001 | Fujii et al. | |
| 6,217,429 | B1 * | 4/2001 | Hoey | 451/443 |
| 6,234,868 | B1 | 5/2001 | Easter et al. | |
| 6,508,697 | B1 * | 1/2003 | Benner et al. | 451/443 |
| 6,572,446 | B1 | 6/2003 | Osterheld et al. | |
| 6,746,318 | B2 * | 6/2004 | Mallery et al. | 451/285 |
| 6,905,399 | B2 | 6/2005 | Lischka | |
| 7,004,825 | B1 * | 2/2006 | Taylor et al. | 451/72 |
| 7,040,967 | B2 * | 5/2006 | Benner | 451/56 |
| 7,052,371 | B2 * | 5/2006 | Benner | 451/36 |
| 7,182,680 | B2 | 2/2007 | Butterfield et al. | |
| 7,258,600 | B1 * | 8/2007 | Benner | 451/72 |
| 2001/0009844 | A1 | 7/2001 | Cho et al. | |
| 2004/0121710 | A1 * | 6/2004 | Boyd | 451/56 |
| 2004/0241989 | A1 * | 12/2004 | Benner | 438/689 |
| 2005/0164606 | A1 * | 7/2005 | Benner et al. | 451/5 |
| 2007/0087672 | A1 * | 4/2007 | Benner | 451/56 |

* cited by examiner

*Primary Examiner*—Maurina Rachuba
(74) *Attorney, Agent, or Firm*—Patterson & Sheridan, LLP

(57) ABSTRACT

A method and apparatus for conditioning is provided. In one embodiment, a conditioning disk includes a plurality of conditioning elements each having an abrasive working surface, and a flexible foundation having the conditioning elements coupled thereto. The flexible foundation has physical properties that retain the working surfaces in a substantially coplanar orientation with respect to the pad surface.

8 Claims, 10 Drawing Sheets

PAD CONDITIONING DEVICE WITH FLEXIBLE MEDIA MOUNT

CROSS REFERENCE TO RELATED APPLICATION

This application claims benefit to U.S. Provisional Patent Application Ser. No. 60/863,563, filed Oct. 30, 2006, which is incorporated by reference in its entirety.

BACKGROUND OF THE INVENTION

1. Field of the Invention

Embodiments of the invention generally relate to a method and apparatus for conditioning a polishing pad.

2. Description of the Related Art

Chemical Mechanical Planarization (CMP) and Electrochemical Mechanical Planarization (ECMP) are a techniques utilized to planarize a substrate during integrated circuit fabrication. Both techniques move a substrate laterally against a processing pad during processing in the presence of a processing fluid.

The processing pad must have the appropriate mechanical properties for substrate planarization and bulk removal while minimizing the generation of defects in the substrate during polishing. Such defects may be scratches in the substrate surface caused by raised areas of the pad or by polishing by-products disposed on the surface of the pad, such as abraded portions of the pad, agglomerations of abrasive particles from a polishing slurry, removed materials from the substrate, and the like. The processing pad generally deteriorates naturally during polishing due to wear and/or accumulation of polishing by-products on the pad surface. Thus, the pad surface must periodically be refreshed, or conditioned, to restore the performance of the pad. Conventionally, an abrasive conditioning disk is used to work the top layer of the pad surface into a state that possesses desirable polishing results. However, conventional conditioning processes that aggressively interact with the pad may have an adverse affect on the pad lifetime. Additionally, conditioning uniformity is difficult to achieve as one portion of the abrasive disk may dress the pad at a rate different than another portion of the disk. This may be due to unequal or non-uniform pressure applied between the pad and conditioner, poor conditioner planarity, non-uniform distribution of abrasives on the conditioner's working surface, or combinations thereof. As pads utilized in ECMP processes are generally softer than conventional CMP pads, problems conditioning ECMP pads are aggravated.

Therefore, there is a need for an improved method and apparatus for conditioning processing pads.

SUMMARY OF THE INVENTION

A method and apparatus for conditioning is provided. In one embodiment, a conditioning disk includes a plurality of conditioning elements each having an abrasive working surface, and a flexible foundation having the conditioning elements coupled thereto. The flexible foundation has physical properties that retain the working surfaces in a substantially coplanar orientation.

In another embodiment, a condition mechanism is provided. The condition mechanism includes a housing having a cavity, a flexible foundation and a plurality of conditioning elements. The flexible foundation is coupled to the housing and has a first side bounding a portion of the cavity. The conditioning elements are coupled to a second side of the flexible foundation. Each conditioning element has an abrasive working surface. The flexible foundation has physical properties that retain the working surfaces in a substantially coplanar orientation independent of operational forces applied to the first side of the flexible foundation from within the cavity.

In yet another embodiment, a method for condition is provided that includes contacting a processing pad with a condition disk, and providing relative motion between the pad and working surfaces while maintaining contact therebetween. The disk comprises a plurality of conditioning elements each having an abrasive working surface, and a circular flexible foundation having the conditioning elements coupled thereto. The flexible foundation has physical properties that retain the working surfaces in a substantially coplanar orientation while pressed against the pad.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Figure 1A:
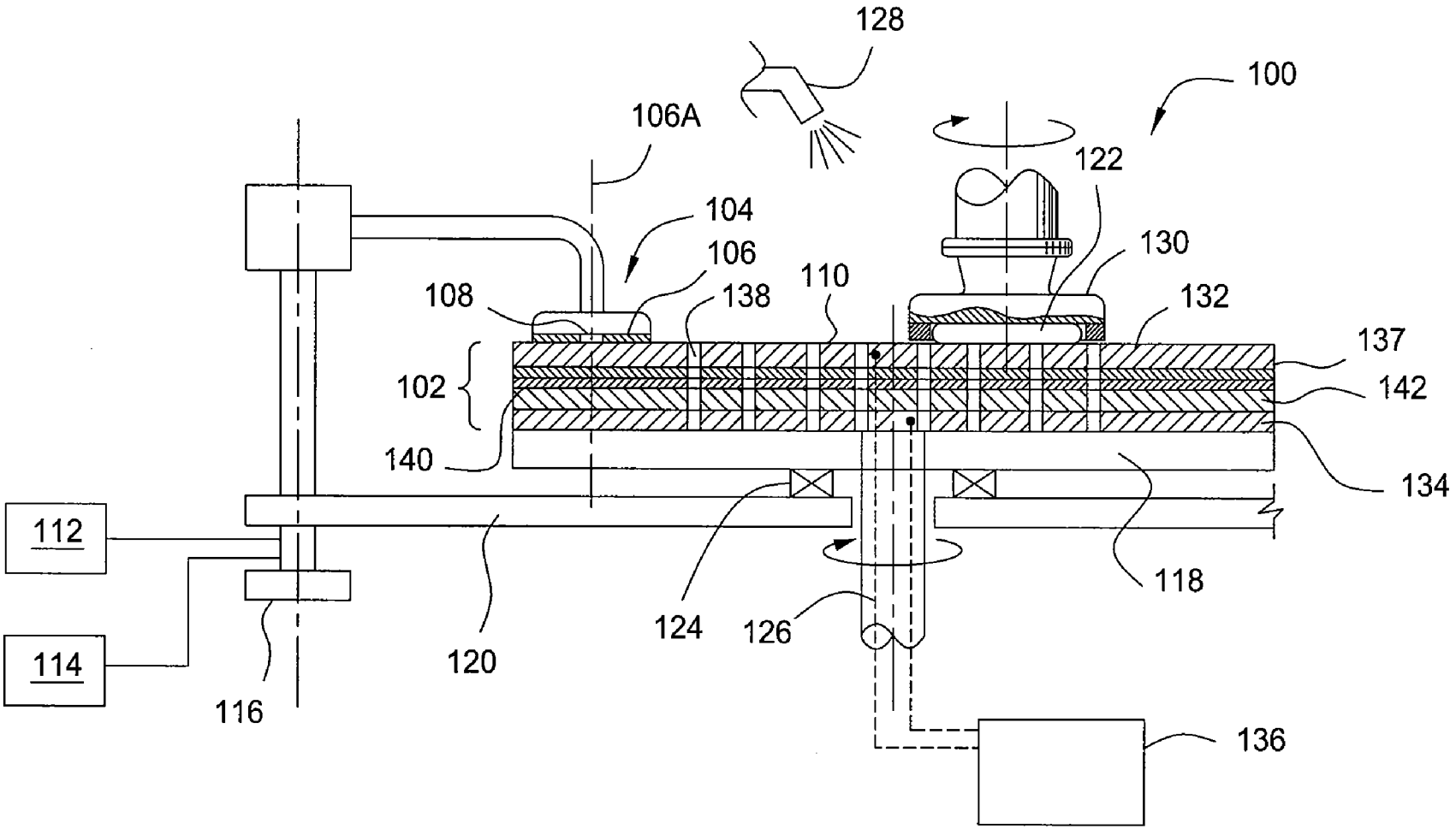
FIG. 1A is a partial sectional view of a polishing station having a conditioning disk of the present invention.

FIG. 1A depicts one embodiment of a planarization station 100 suitable for planarizing a substrate 122 on a processing pad 102. The processing pad 102 is periodically conditioned by a conditioning device 104.

The conditioning device 104 includes an inventive conditioning disk 106. The conditioning disk may include one or more passages 108 through which fluid and/or debris may be suctioned from the working surface 110 of the pad 102 by a vacuum source 112. Alternatively, or in addition to, the apertures 108 may be coupled to a cleaning fluid source 114 to provide a cleaning fluid to the working surface 110 of the pad 102. The conditioning device 104 generally includes one or more actuators 116 which control the position of the conditioning disk 106 relative to the pad 102 and provides rotational motion about a center line 106A of the disk 106. Other embodiments are depicted in FIGS. 2C-E.

In the embodiment depicted in FIG. 1A, the planarization station 100 includes a platen 118 supported over a base 20 by a bearing 124. The platen 118 is coupled by a shaft 126 to a motor (not shown) which rotates the platen 118 during conditioning and substrate processing. The pad 102 is disposed on the platen 118. A polishing fluid delivery nozzle 128 is typically positioned over the pad 102 to provide polishing fluid to the working surface 110 of the pad 102 upon which the substrate 122 is processed.

A polishing head 130 retains the substrate 122 against the working surface 110 during processing. The polishing head 130 is coupled to a motor (not shown) which provides rotational and/or other motion to the substrate 122 relative to the working surface 110 of the pad 102 during processing.

In the embodiment depicted in FIG. 1A, the pad 102 includes a fully-conductive upper layer 132 and an underlying conductive layer 134. The layers 132, 134 are coupled to respective poles of a power source 136. The substrate 122, when in contact with the pad 102, is biased by the conductive upper surface 132. Apertures 138, provided in at least the conductive layer 132, allow polishing fluid provided from the nozzle 128 to establish a conductive path between the substrate 122 and the conductive layer 134. The pad may also include one or more layers intervening between the upper conductive layer 132 and the conductive layer 134. In the embodiment depicted in FIG. 1A, the intervening layers include a conductive fabric layer 137, interposed layer 140 (such as a plastic sheet), and a subpad 142. The subpad 142 may be comprised of a dielectric layer such as polyurethane. One embodiment of such a processing pad is described in U.S. patent application Ser. No. 10/455,895 filed Jun. 6, 2003 by Hu, et al., which is incorporated herein by reference.

Figure 1B:
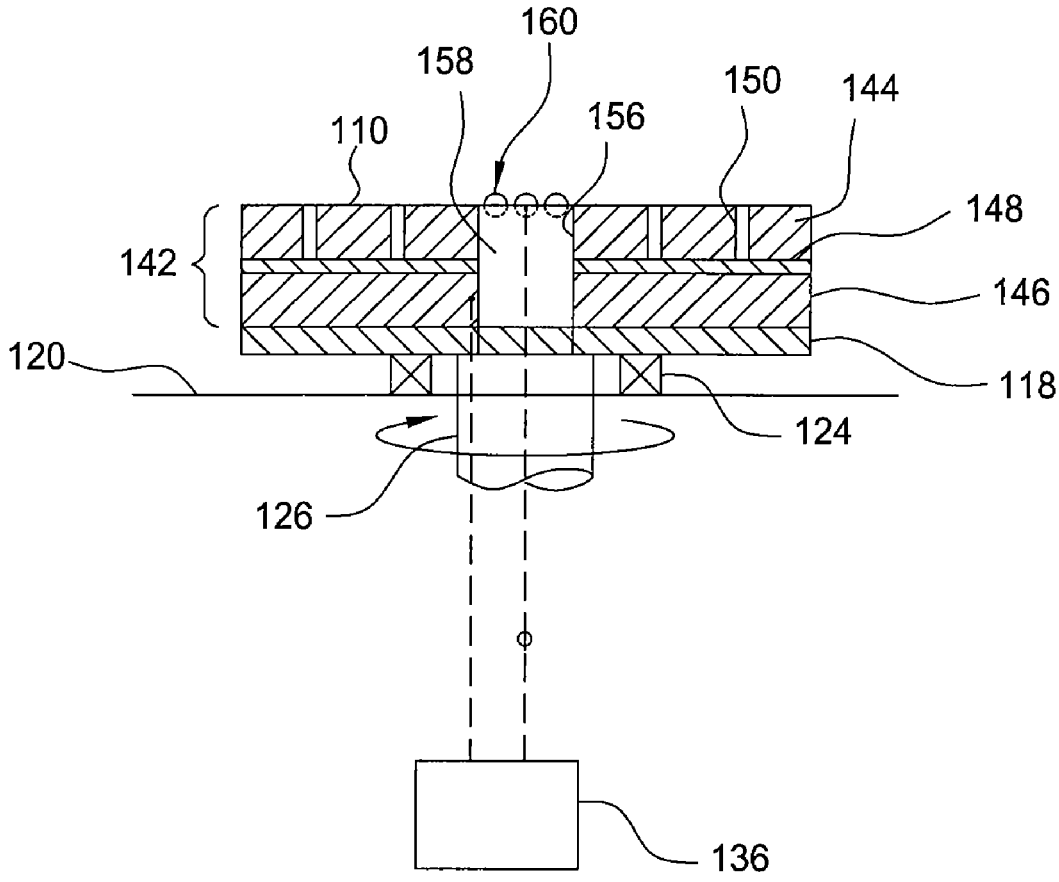
FIG. 1B-C are a partial sectional views of other processing pads which may benefit from conditioning with the conditioning disk depicted in FIG. 1A.
Figure 1C:
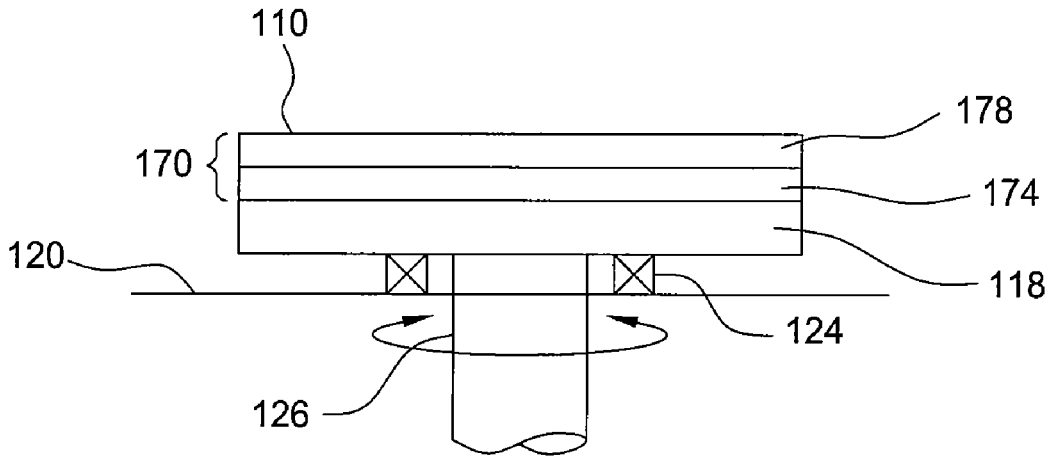

FIGS. 1B-C depict other embodiments of processing pads in which the inventive conditioning disk 106 may be beneficially utilized. It is also contemplated that the conditioning disk 106 may be beneficially utilized to condition other processing pads. In the embodiment depicted in FIG. 1B, a pad 142 is provided that has an upper dielectric layer 144 and a lower conductive layer 146. The conductive layer 146 is supported by the platen 118. A dielectric subpad 148 may be optionally interposed between the layers 144, 146. A plurality of apertures 150 extend through the upper layer 144 to expose a portion of the conductive layer 146 to the working surface 110 of the pad 142.

One or more contact elements 158 are coupled to at least one of the pad 142 or platen 118. In the embodiment depicted in FIG. 1B, a single contact element 158 extends through an aperture 156 formed through the pad 142. The contact element 158 includes at least one conductive contact, such as a plurality of conductive balls 160, which extend at least coplanar with a working surface 110 of the pad 142, such that during processing, the balls 160 and the working surface 110 are in contact with the substrate 122 (not shown in FIG. 1B).

The balls 160 and conductive layer 146 are coupled to respective poles of a power source 136. The balls 160 bias the substrate 160 when the substrate 122 is disposed on the pad 142. When the apertures 150 are filled with a processing fluid, a conductive fluid path is established between the substrate 122 and conductive layer 146, as described above, which facilitates electrochemical mechanical processing of the substrate. Such a process is described in U.S. Pat. No. 7,084,064, issued Aug. 1, 2006 to Liu, et al., which is incorporated herein by reference in its entirety.

In another example depicted in FIG. 1C, another processing pad 170 is shown on which the inventive conditioning disk 106 may be utilized. In the embodiment depicted in FIG. 1C, the pad 170 includes an upper dielectric layer 172 and a subpad 174. The upper dielectric layer 172 is typically fabricated from polyurethane. The subpad 174 is fabricated from a material that enhances the compliance and conformance of the pad 170. These pads are commonly utilized in conventional chemical mechanical polishing.

Figure 2A:
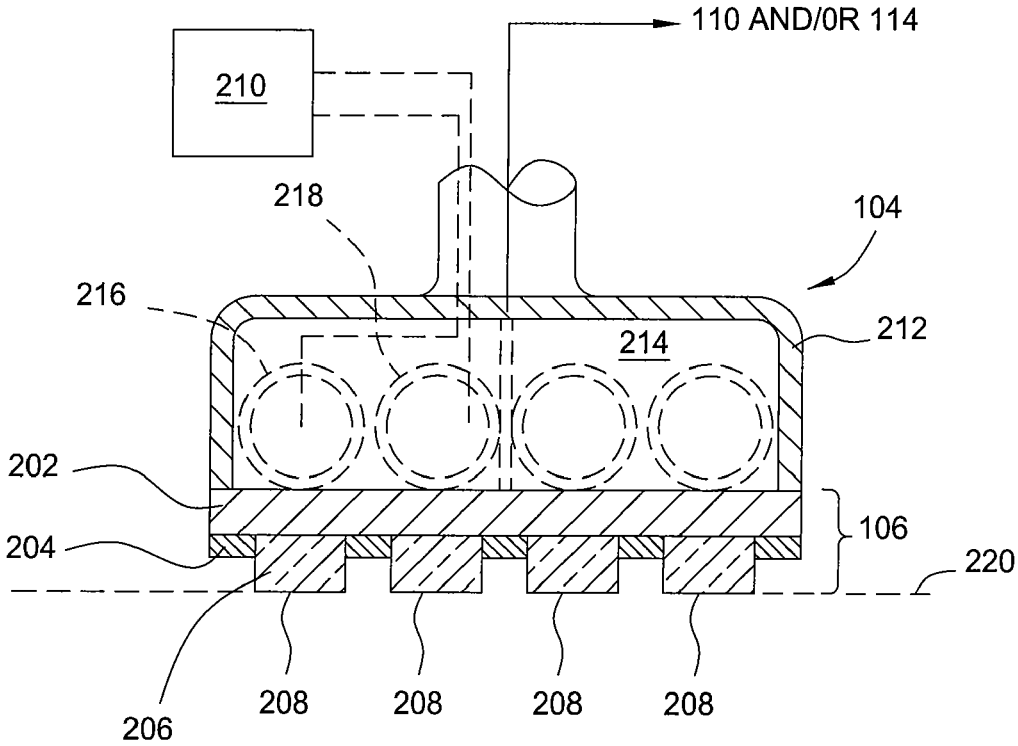
FIG. 2A is a sectional view of an exemplary embodiment of a conditioning mechanism having one embodiment of a conditioning disk of the present invention.
Figure 2B:
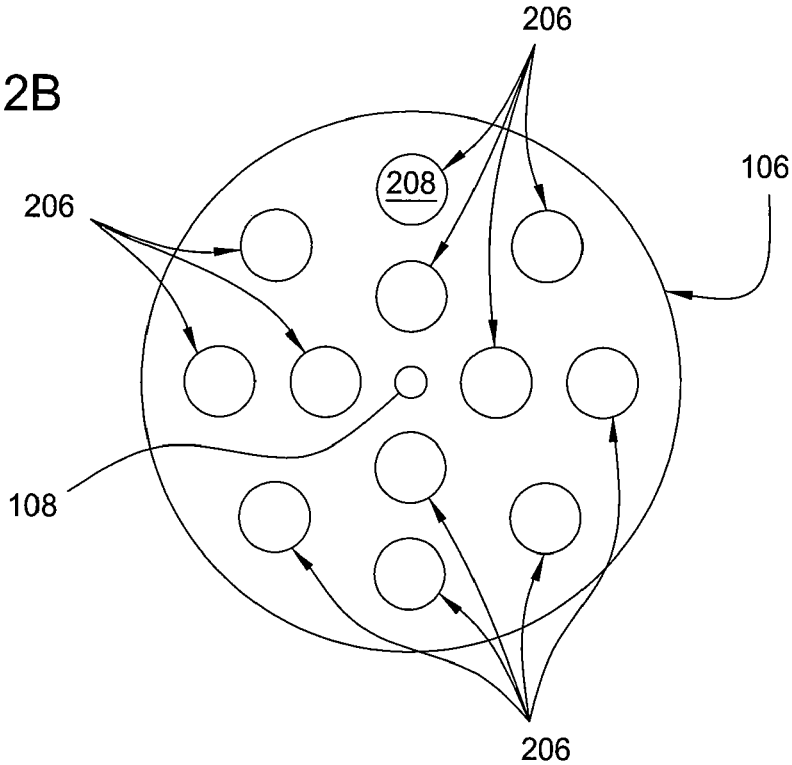
FIG. 2B is a bottom view of the conditioning disk of FIG. 2A.
Figure 2C:
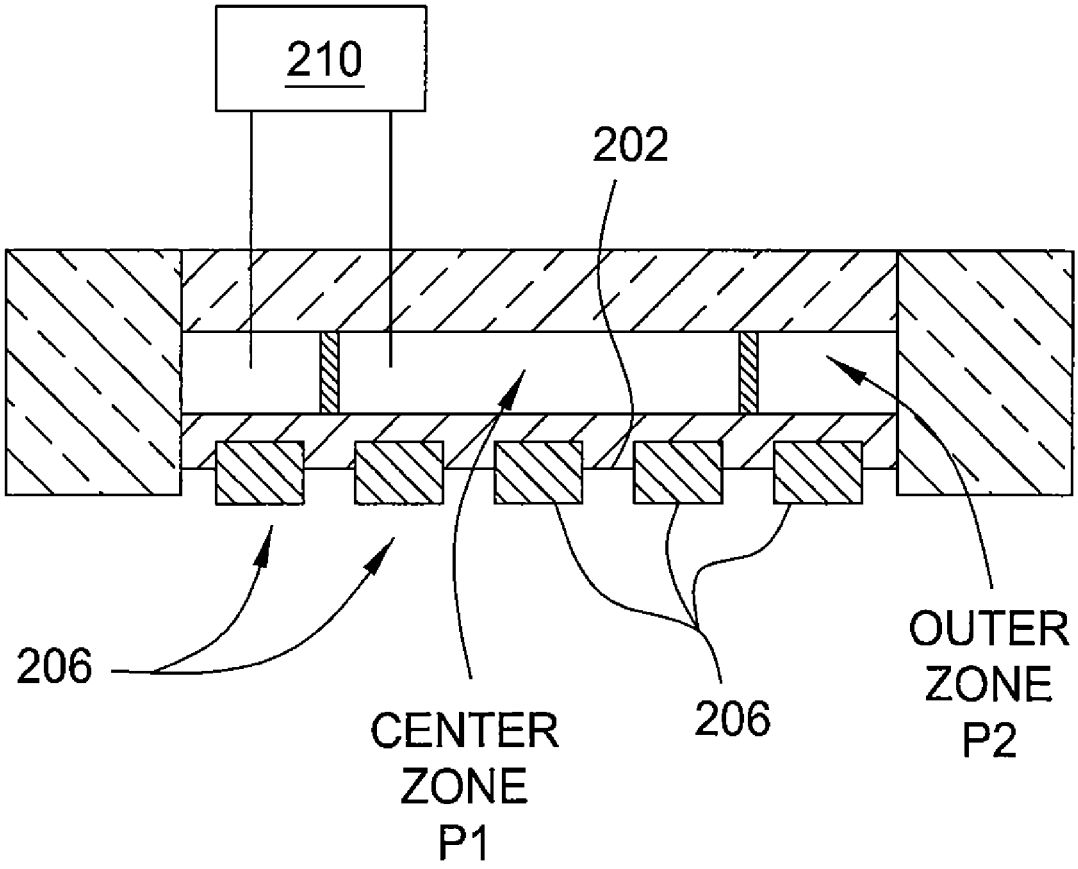
FIG. 2C is a sectional view of another embodiment of a conditioning mechanism.
Figure 2D:
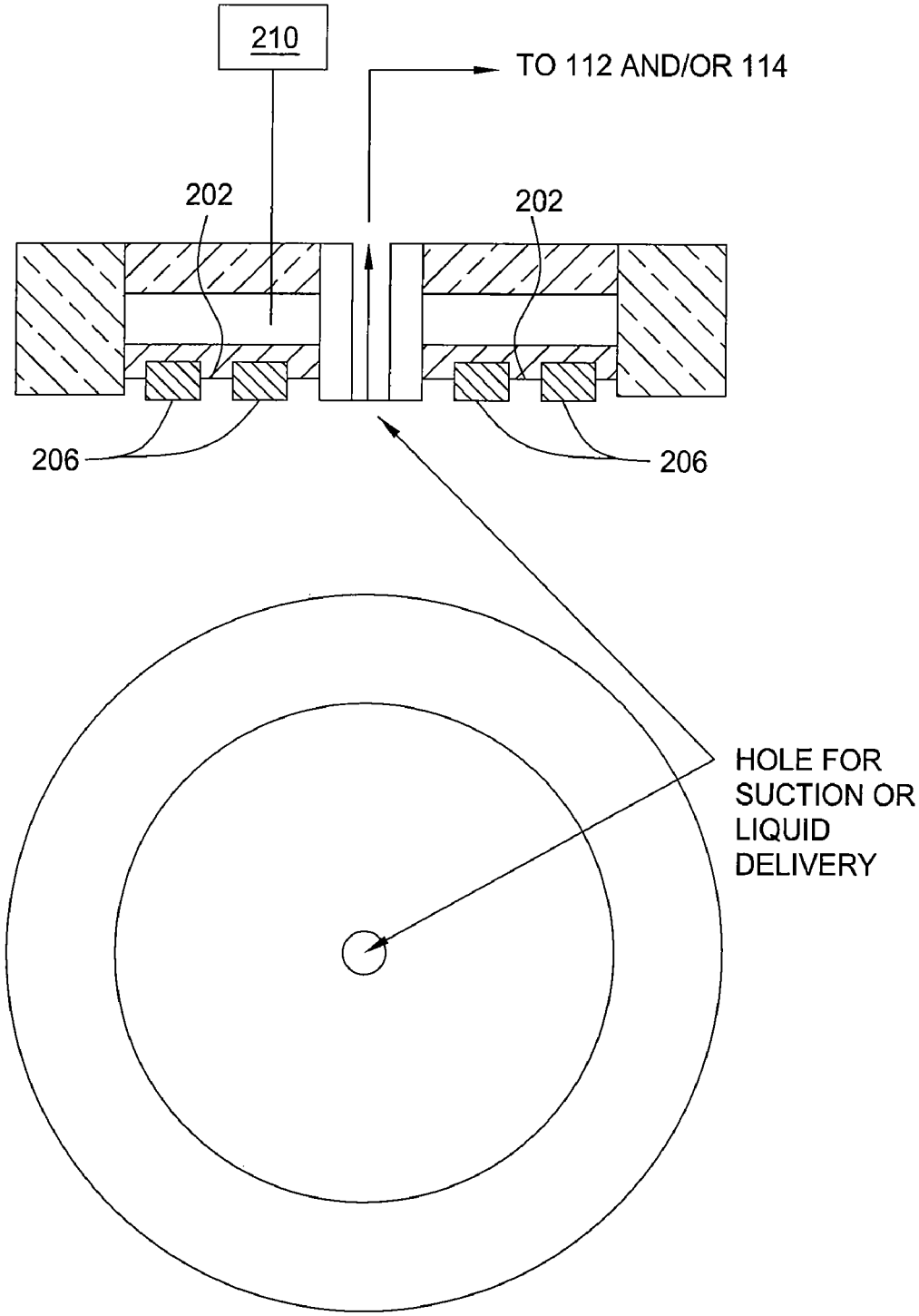
FIGS. 2D-E are a sectional view of other embodiments of a conditioning disk.
Figure 2E:
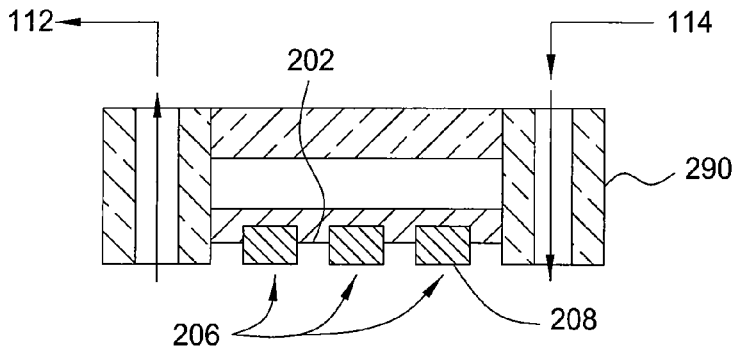
Figure 2E:
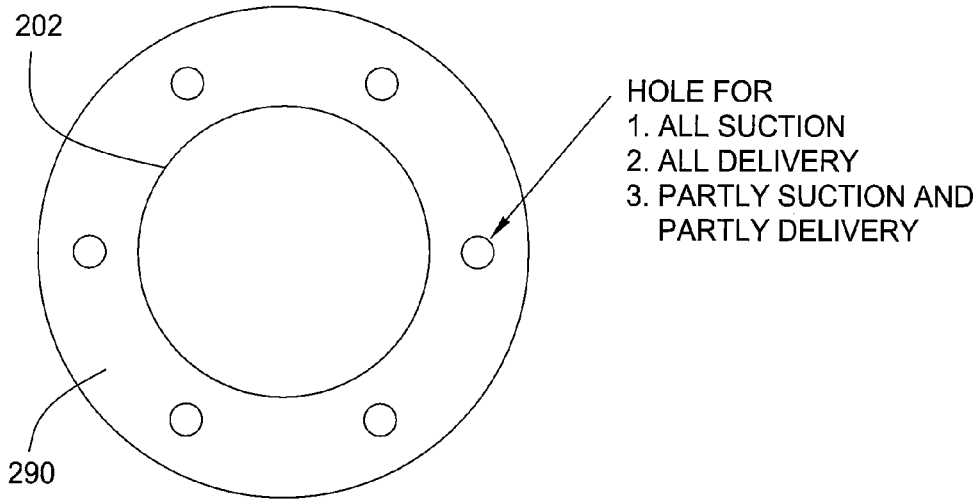

FIG. 2A depicts a partial sectional view of one embodiment of the conditioning mechanism 104. FIG. 2B depicts a partial bottom view of the conditioning disk 106 shown in FIG. 2A. The conditioning mechanism 104 generally includes a housing 212 to which the disk 106 is coupled. The disk 106 may be coupled to the housing 212 by any suitable means, such as clamping, bonding or fastening, among other coupling methods.

A cavity 214 is defined between the housing 212 and disk 106. The cavity 214 may be utilized as an actuator for applying force to the disk 106, for example, as a pressure container or spring housing. In one embodiment, at least one bladder may be disposed in the cavity 214 of the housing 212 and pressurized to urge the disk 106 downward against the processing pad (not shown in FIG. 2A).

A plurality of bladders or other force generators may be used to selectively apply force to different regions of the disk 106. In the embodiment depicted in FIG. 2A, a first bladder 216 and second bladder 218 are disposed in the housing 214. The bladders 216, 218 are coupled to a pressure source 210. Pressure to each bladders 216, 218 may be individually controlled such that pressure profile across the disk 106 may be tailored. In one example, pressures within the bladders 216, 218 may range between about 0.05 to about 5 psi. In the embodiment depicted in FIG. 2A, the bladders 216, 218 are concentric such that the edge to center pressure profile of the disk 106 is controllable. It is contemplated that the bladders or other force generating devices may be utilized in the housing 212 such that any selected region of the disk 106 may have a different pressure applied thereto relative to another region. FIG. 2C depicts another variation of multi-zoned pressure application to enable different pressures to be applied to the pad from different regions of the conditioning disk 106.

In reference to FIGS. 2A-B, the disk 106 includes a flexible foundation 202 having a plurality of conditioning elements 206 coupled thereto. An in-plane stress-bearing layer 204 is also coupled to the flexible foundation 202 and the conditioning elements 206. The flexible foundation is generally fabricated from a material having sufficient physical properties such that pressure applied to the upper surface of the disk 106 is distributed to the conditioning elements 206 in a manner that the working surfaces 208 of the conditioning elements 206 remain uniform contact with pad surface 220.

In one embodiment, the flexible foundation 202 has properties similar to rubber. Suitable materials for the flexible foundation 202 include nitrile, EPDM, fluorocarbon, neoprene, silicone, and fluorosilicone, among other suitable materials.

In one embodiment, the in-plane stress-bearing layer 204 is made of fabrics. Suitable materials for the in-plane stress-bearing layer 204 include fabrics made of silk, cotton, nylon, polyester, Nomex®, and stainless steel, among other suitable materials. This layer will maintain the conditioning element in place relative to each other and to the housing under the shear loading from the pad.

In one embodiment, the conditioning elements 206 are plates with abrasive working surface derived from asperity. Typically, the working surfaces 208 of the conditioning elements contain a plurality of protrusions formed by mechanical features or abrasive particles, such as diamonds. Some suitable conditioning elements 206 which may be adapted to benefit from the invention are described in U.S. Provisional Patent Application Ser. No. 60/807,066 filed Jul. 11, 2006 by Yilmaz et al., and U.S. patent application Ser. No. 11/142,918 filed Jun. 2, 2006 by Yuan A. Tian et al., both of which are hereby incorporated by reference in their entireties.

The characteristic length of conditioning elements 206 is generally shorter than the diameter of the disk 106 such that flatness tolerances, for example less than 25 microns, may be maintained, without expensive manufacturing techniques. The flatness of the conditioning elements 206, along with the stability provided by the flexible foundation 202 enables the working surfaces 208 to be maintained in a substantially coplanar arrangement with pad surface, independent of the forces applied behind the individual elements 206, thereby enabling superior conditioning uniformity, and predictable and repeatable profile control compared to conventional designs.

In other embodiment, the conditioning elements 206 may move relative to each other vertically to follow the pad surface contour. However, the flexible foundation 202 enables the working surfaces of the elements 206 in uniform contact with the pad surface, and therefore, uniform conditioning down pressure, even if a small variation from coplanar alignment occurs.

Figure 3A:
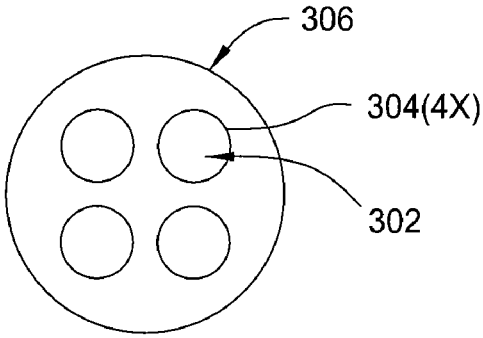
FIG. 3A-H are a bottom views of alternate embodiments of a conditioning disk.
Figure 3C:
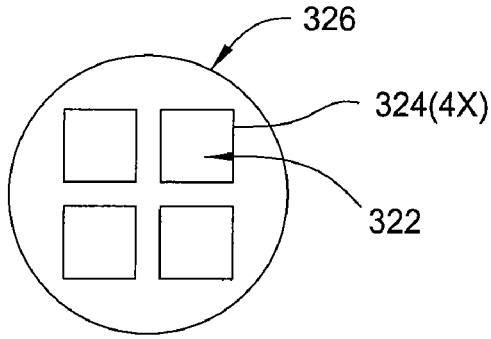
Figure 3D:
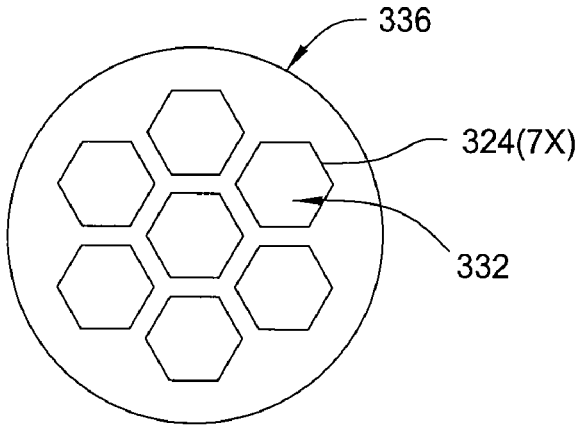
Figure 3B:
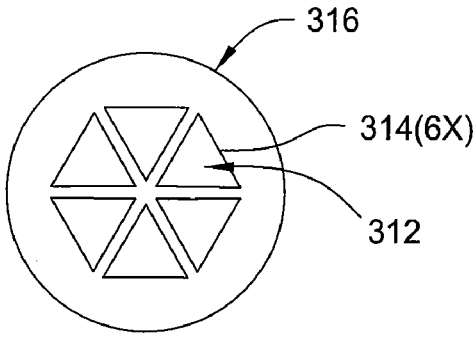

As depicted in FIG. 2B, the conditioning elements 206 may have a substantially circular working surfaces 208 arranged in a polar array. It is also contemplated that the conditioning elements may have working surfaces having other geometries or distributions as viewed from the bottom surface of the conditioning disk. For example, in the embodiment depicted in FIG. 3A, working surfaces 302 of condition elements 304 extending from a disk 306 have a circular geometry arranged in a grid-like array. In another embodiment depicted in FIG. 3B, working surfaces 312 of condition elements 314 extending from a disk 316 have a wedge-like or triangular geometry arranged in a polar array. In another embodiment depicted in FIG. 3C, working surfaces 322 of condition elements 324 extending from a disk 326 have a quadrilateral or square geometry arranged in a grid-like array. In yet another embodiment depicted in FIG. 3D, working surfaces 332 of condition elements 334 extending from a disk 336 have nested arrangement. The nested working surfaces 332 may have any shape, although a polygonal (for example, hexagonal) geometry is shown in FIG. 3D.

Figure 3E:
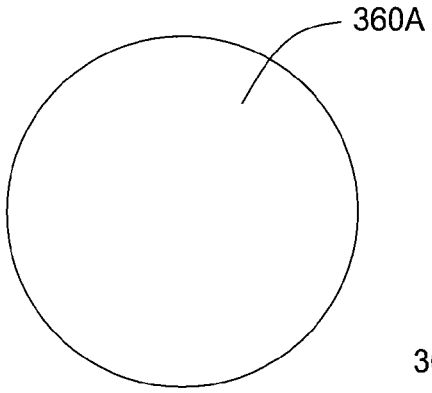
Figure 3F:
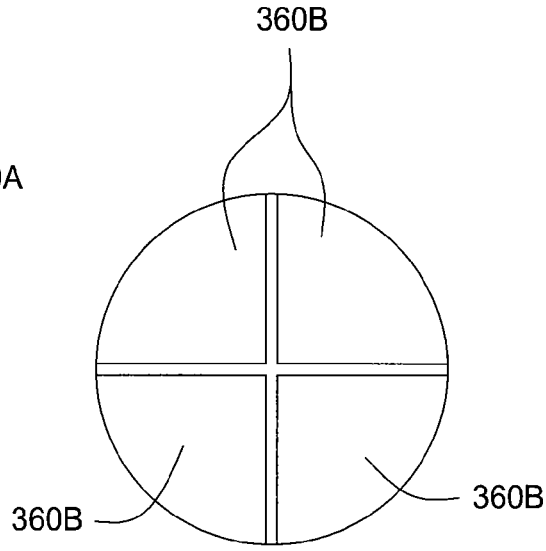
Figure 3G:
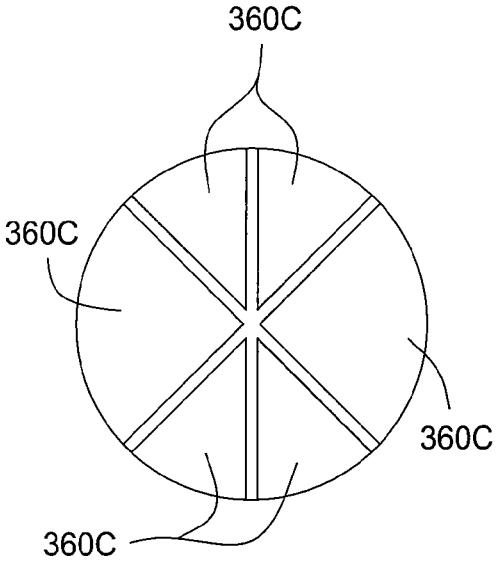
Figure 3H:
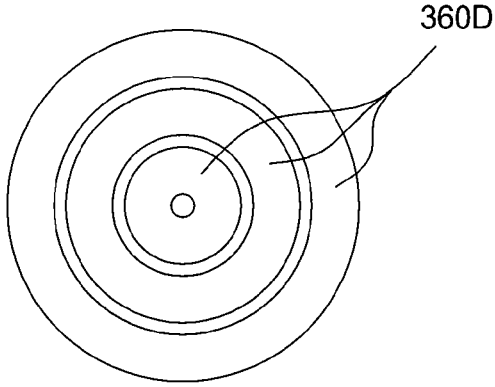

In another embodiment, there could also be a single conditioning element 360A having one working surface on a flexible mount, as shown in FIG. 3E. In another embodiment, conditioning elements 360B may be arranged as quadrants of a circle, as shown in FIG. 3F. In another embodiment, conditioning elements 360C may be arranged as sectors of a circle, as shown in FIG. 3G. In another embodiment, conditioning elements 360D may be arranged as concentric rings, as shown in FIG. 3H.

Figure 4:
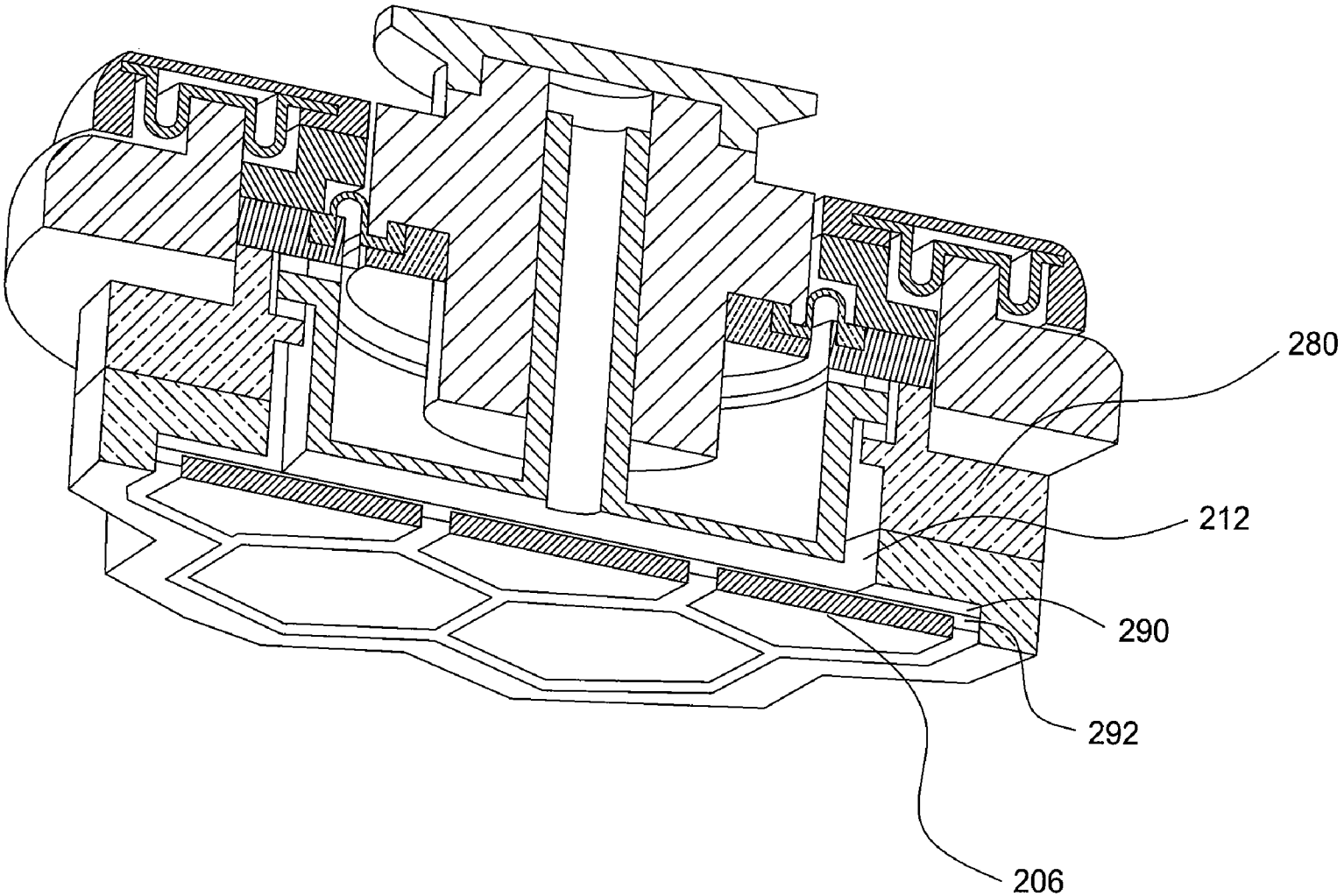
FIG. 4 is a perspective sectional view of another embodiment of a conditioning mechanism having one embodiment of a conditioning disk of the present invention.

FIG. 4 depicts one embodiment of a housing 212 having a reference ring contacting the pad surface so that the conditioning device follows pad as the vertical position of the pad portion being conditioned changes due to any mechanical run-out or other asperities. For example, in FIG. 4, the housing 212 includes a reference ring 290 that circumscribes a flexible mount 292 and conditioning elements 206. This arrangement ties the vertical position of the conditioning elements 206 to the reference ring 290. The reference ring 290 is configured to ride on the working surface of the polishing pad during conditioning. As the reference ring 290 moves upward and downward following asperities and/or mechanical run-out in the polishing pad and/or platen, the flexible mount 292 and conditioning elements 206 move with the ring 290 without changing the volume of the pressurizing chamber 280. Thus, the pressure applied between the conditioning elements 206 and the pad may be precisely controlled independent of mechanical run-out or large scale pad topography changes with cause the elevation of the housing to change as the pad rotates during conditioning.

Thus, a conditioning disk has been provided that enables robust conditioning. The flexible foundation allows uniform contact between the working surfaces of the conditioning disk and the polishing pad, while the individual conditioning elements improve flatness with reduced fabrication costs.

While the foregoing is directed to embodiments of the invention, other and further embodiments of the invention may be devised without departing from the basic scope thereof, and the scope thereof is determined by the claims that follow.

What is claimed is:

1. A conditioning disk for conditioning a polishing pad, comprising:

a plurality of conditioning elements each having an abrasive working surface;

a flexible foundation having the conditioning elements coupled thereto, the flexible foundation having physical properties that retain the working surfaces in a substantially coplanar orientation with the polishing pad; and an in-plane stress-bearing layer coupled to the flexible foundation and the conditioning elements.

2. A conditioning mechanism for conditioning a polishing pad, comprising:

a housing having a cavity;

a flexible foundation coupled to the housing and having a first side bounding a portion of the cavity;

a plurality of conditioning elements coupled to a second side of the flexible foundation, each conditioning element having an abrasive working surface, the flexible foundation having physical properties that retain the working surfaces in a substantially coplanar orientation independent of operational forces applied to the first side of the flexible foundation; and an in-plane stress-bearing layer coupled to the flexible foundation and the conditioning elements.

3. A conditioning disk for conditioning a polishing pad, comprising:

a plurality of conditioning elements each having an abrasive working surface;

a flexible foundation having the conditioning elements coupled thereto, the flexible foundation having physical properties that retain the working surfaces in a substantially coplanar orientation with the polishing pad;

an in-plane stress-bearing layer coupled to the flexible foundation and the conditioning elements; and a reference ring circumscribing the flexible foundation.

4. The disk of claim 2, further comprising:

a reference ring circumscribing the flexible foundation.

5. A conditioning disk for conditioning a polishing pad, comprising:

a plurality of conditioning elements each having an abrasive working surface;

a flexible foundation having the conditioning elements coupled thereto, the flexible foundation having physical properties that retain the working surfaces in a substantially coplanar orientation with the polishing pad;

an in-plane stress-bearing layer coupled to the flexible foundation and the conditioning elements; and at least one bladder in communication with the flexible foundation.

6. The disk of claim 2, further comprising:

at least one bladder disposed in the cavity and in communication with the flexible foundation.

7. A conditioning disk for conditioning a polishing pad, comprising:

a plurality of conditioning elements each having an abrasive working surface;

a flexible foundation having the conditioning elements coupled thereto, the flexible foundation having physical properties that retain the working surfaces in a substantially coplanar orientation with the polishing pad; and an in-plane stress-bearing layer coupled to the flexible foundation and the conditioning elements, wherein the flexible foundation further comprises:

a plurality of pressure application regions.

8. The disk of claim 2, wherein the plurality of abrasive working surfaces are divided into individual pressure zones.

* * * * *